US006289861B1

(12) United States Patent
Suzuki

(10) Patent No.: US 6,289,861 B1
(45) Date of Patent: Sep. 18, 2001

(54) CONTROL FOR VARIABLE VALVE TIMING

(75) Inventor: Katsuhiro Suzuki, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/562,001

(22) Filed: May 2, 2000

(30) Foreign Application Priority Data

May 31, 1999 (JP) ..... 11-152642
Oct. 15, 1999 (JP) ..... 11-293948

(51) Int. Cl.[7] ..... F01L 1/34; F02B 1/00

(52) U.S. Cl. ..... 123/90.17; 123/90.34; 123/90.37; 123/90.38; 123/193.3; 123/196 M

(58) Field of Search ..... 123/90.15, 90.17, 123/90.31, 90.33, 90.34, 90.37, 90.38, 193.3, 196 M

(56) References Cited

U.S. PATENT DOCUMENTS 5,797,363 * 8/1998 Nakamura ..... 123/90.17
5,954,019 * 9/1999 Yoshikawa et al. ..... 123/90.17
6,035,817 * 3/2000 Uchida ..... 123/90.17
6,076,492 * 6/2000 Takahashi ..... 123/90.17
6,186,105 * 2/2001 Yonezawa ..... 123/90.17

* cited by examiner

*Primary Examiner*—Weilun Lo
(74) *Attorney, Agent, or Firm*—Ernest A. Beutler

(57) ABSTRACT

Three embodiments of twin overhead camshaft internal combustion engines employing variable valve timing mechanisms for each camshaft. In each embodiment, the variable valve timing mechanisms are supplied with hydraulic fluid from the engine lubricating system through a common supply passage that is formed in the cylinder head and disposed between the variable valve timing mechanism control valves. These control valves are, in turn, disposed between the camshafts at the front of the engine to provide a very compact assembly.

20 Claims, 6 Drawing Sheets

CONTROL FOR VARIABLE VALVE TIMING

BACKGROUND OF THE INVENTION

This invention relates to an internal combustion engine and particularly a four-cycle internal combustion engine and a control valve arrangement for controlling the variable valve timing mechanism of such engines.

It has been acknowledged that the performance of four cycle engines can be substantially improved during a wider range of engine running conditions if a variable valve timing mechanism (VVT) is employed. By changing the valve timing, it is possible to obtain the optimum valve timing conditions for each engine running condition.

Some variable valve timing mechanisms adjust the timing of only one of the camshafts. However, considerable improvement can be obtained in engine performance if both camshafts have a variable valve timing mechanisms associated with them. Although this can significantly improve the engine performance, it also makes the overall engine construction more complicated.

Basically, most VVT mechanisms include a drive to the camshaft from the engine crankshaft that includes a mechanism that is operative to change the phase angle between the driven camshaft and the crankshaft. In this way, it is possible to vary the variable valve timing during engine running. Frequently, these mechanisms are hydraulically operated and often use the same hydraulic fluid that is utilized to lubricate the engine.

In order to control the valve timing and specifically the operation of the VVT mechanism, a control valve selectively pressurizes or depressurizes one or more chambers of the variable valve timing mechanism. This requires the provision of not only a control valve and an actuator for it but also the provision of supply passages for delivering the lubricant to and from the control valve to the variable valve timing mechanism. Where two adjacent camshafts are controlled, the structure generally is duplicated and hence, the problems of locating passages, et cetera and the valves and the valve controls become more complicated.

Normally, it has been the practice to position the control valves on the engine side of the drive for the variable valve timing mechanism which is generally provided in a timing case or cover at one end of the engine. Hence, the valves are disposed at some axial distance from the variable valve timing mechanisms with which they cooperate. This gives rise to certain problems in connection with not only engine size but also in the provision of adequate passages for supplying and transferring the actuating fluid between the components.

It is, therefore, a principal object of this invention to provide an improved and compact variable valve timing control mechanism for an engine having a pair of adjacent camshafts, each of which has a variable valve timing mechanism associated with it.

It is a further object to this invention to provide an improved engine construction and control valve arrangement for a VVT mechanism that can be compact and shorten the supply passages and passages interconnecting the valves to the VVT mechanisms.

Another problem in connection with the supply of lubricating oil to the variable valve timing mechanisms is that of pressure drop. Obviously, a fairly significant pressure is required in order to achieve the shifting of the variable valve timing mechanism, particularly when this shifting occurs when the valves are being opened and closed. Therefore, any pressure drops or pressure variations can cause difficulties in operation.

Generally it has been the practice to provide a separate supply passage that extends from a source to each of the control valves. As noted previously, these control valves are also located rather remotely from the variable valve timing mechanism so pressure variations obviously become a problem.

It is, therefore, a still further object to this invention to provide an improved control arrangement for an engine VVT mechanism that is compact and which minimizes the number and length of the necessary fluid passages.

SUMMARY OF THE INVENTION

This invention relates to an internal combustion engine comprised of a cylinder head assembly having a pair of camshafts rotatable about parallel axes for operating a plurality of valves in the cylinder head assembly. A camshaft drive mechanism is provided at one end of the cylinder head assembly for driving the camshafts from the engine output shaft in timed relation. The drive for each camshaft includes a variable valve timing mechanism including a hydraulically actuated element for varying the valve timing. A pair of control valves are mounted in the cylinder head assembly in the area between the camshafts and disposed immediately adjacent to the variable valve timing mechanisms for controlling their individual operation.

In accordance with one feature of the invention, the valve mechanisms are disposed to reciprocate about axes that extend perpendicularly to the camshaft axes and the interface between the cylinder head and an associated cylinder block.

In accordance with another feature of the invention, a single supply passage is provided in the cylinder head assembly for supplying hydraulic fluid to each of the control valve assemblies.

DETAILED DESCRIPTION OF THE PREFERRED EMBODIMENTS OF THE INVENTION

Figure 1:
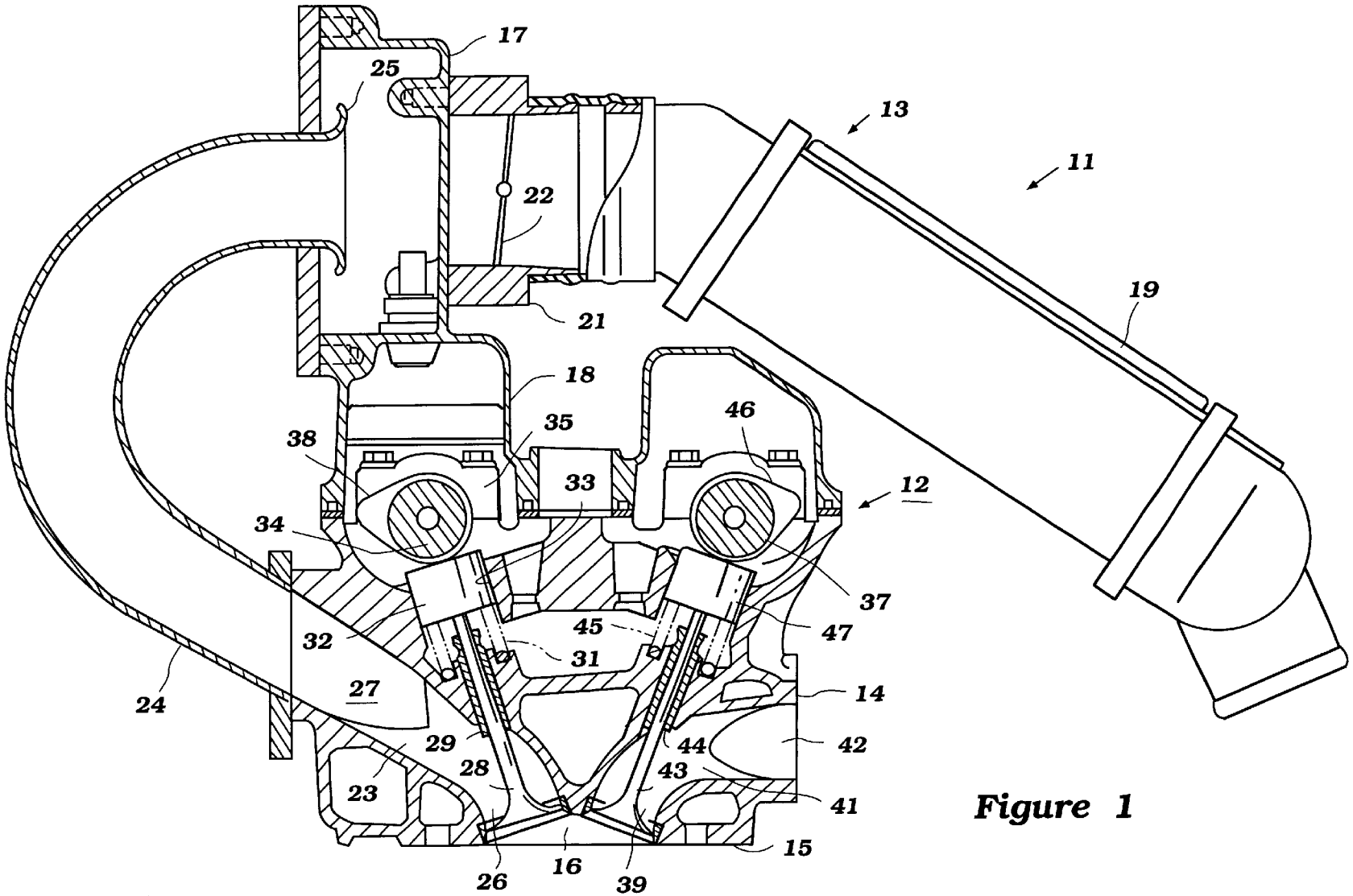
FIG. 1 is a partial cross sectional view taken along a plane extending perpendicularly to the axes of rotation of the engine crankshaft and of the camshafts.

Referring now in detail to the drawings and initially to the embodiment of FIGS. 1 through 4, an internal combustion engine constructed and operated in accordance with this embodiment of the invention is identified generally by the reference numeral 11. As should be apparent from the foregoing description, the invention deals primarily with the valve actuating mechanism of a four-cycle, overhead valve type, engine. For that reason, the drawings only show in detail the cylinder head assembly, indicated generally by the reference numeral 12, for the engine 11 and portions that are associated with it including an induction system, indicated generally by the reference numeral 13.

The cylinder head assembly 12 includes a main cylinder head member 14, which may be formed as a casting from a lightweight material, such aluminum or an aluminum alloy. The cylinder head member 14 has a lower surface 15 that is held in sealing engagement in a known manner with an associated cylinder block, which is not shown. Although a separate cylinder head assembly is described, it should also be understood that the invention may be employed with engines with the cylinder head and cylinder block form a unitary assembly.

The cylinder head surface 15 is provided with recesses 16 (only one of which is shown) which cooperates with the cylinder bores of the cylinder block and the pistons that reciprocate therein to form the combustion chambers of the engines.

The induction system 13 includes a plenum chamber unit 17 which is formed in part as a unit with a cam cover 18 that is affixed in a known manner to the cylinder head member 14 and which defines a cam chamber in which the valve actuating mechanism, to be described shortly, is contained.

The plenum chamber 17 receives an air charge from an air inlet device 19 via a throttle body assembly 21 in which a flow controlling throttle valve 22 is positioned. Air from the plenum chamber 17 is delivered to cylinder head intake passages 23 via intake manifold runners 24 which have inlet trumpets 25 disposed within the plenum chamber 17.

In the illustrated embodiments, the engine 11 is of the four valves per cylinder type. Hence, the intake passages 23 each terminate in a pair of intake valve seats 26 which are disposed on one side of a plane that contains the axis of the cylinder bore of the associated cylinder block. In the illustrated embodiment, the intake passages 23 are illustrated as being Siamese and have a common inlet opening 27 with which the manifold runners 24 communicate.

Poppet type intake valves 28 are slidably supported in valve guides 29 formed in the cylinder head member 14 for controlling the opening and closing of the intake ports 26. These poppet type intake valves 28 are urged to their closed position by means of coil compression springs 31 which act against the cylinder head member 14 and keeper retainer assemblies (see FIG. 4) fixed to the upper ends of the stems of the intake valves 28.

Thimble type tappets 32 are slidably supported in bores formed in the cylinder head member 14 for opening the intake valves 28. The bores in which the thimble tappets 32 are received are indicated by the reference numeral 33 and appear best in FIG. 3 because the thimble tappets and valves have been removed from this figure to more clearly show the construction.

An intake camshaft 34 is journaled in the cylinder head member 14 by means that includes bearing caps 35 affixed thereto at spaced locations along their length. In addition, at one end of the engine 11, a main bearing cap member 36 is affixed to the cylinder head member 14 and cooperates to journal not only the intake camshaft 34 but also an exhaust camshaft 37 that is journaled on the opposite side of the cylinder head member 14 and support other components which will be described in more detail later.

The intake camshaft 34 has appropriately configured cam lobes 38 that cooperate with the thimble tappets 32 to open the intake valves 28 in a manner that is well known in this art.

Fuel is either mixed with the intake charge delivered by the induction system 13 through any suitable charge former such as carburetors or fuel injectors or may be injected directly into the combustion chambers formed by the cylinder head recesses 16 in any suitable manner. This charge is then ignited, for example by means of one or more spark plugs (not shown) mounted in the cylinder head member 14 in a well known manner.

The burnt charge is discharged from the combustion chambers through exhaust ports 39 that are formed in the cylinder head recesses 16 and which communicate with Siamese type exhaust passages 41 having common discharge openings 42 formed in an outer surface of the cylinder head member 14. A suitable exhaust manifold (not shown) is attached to this surface of the cylinder head member 14 for delivering the exhaust gases to the atmosphere through any known type of exhaust system.

Poppet type exhaust valves 43 are slidably supported in the cylinder head member 14 by exhaust valve guides 44. Like the intake valves 28, coil compression springs 45 bear against the cylinder head member 14 and keeper retainer assemblies fixed to the stems of the exhaust valves 43 for urging the exhaust valves 43 to their closed positions.

The exhaust valves 43 are opened by the exhaust camshaft 37 and specifically by lobes 46 formed thereon which cooperate with thimble tappets 47 in a manner that is well known in this art.

Figure 2:
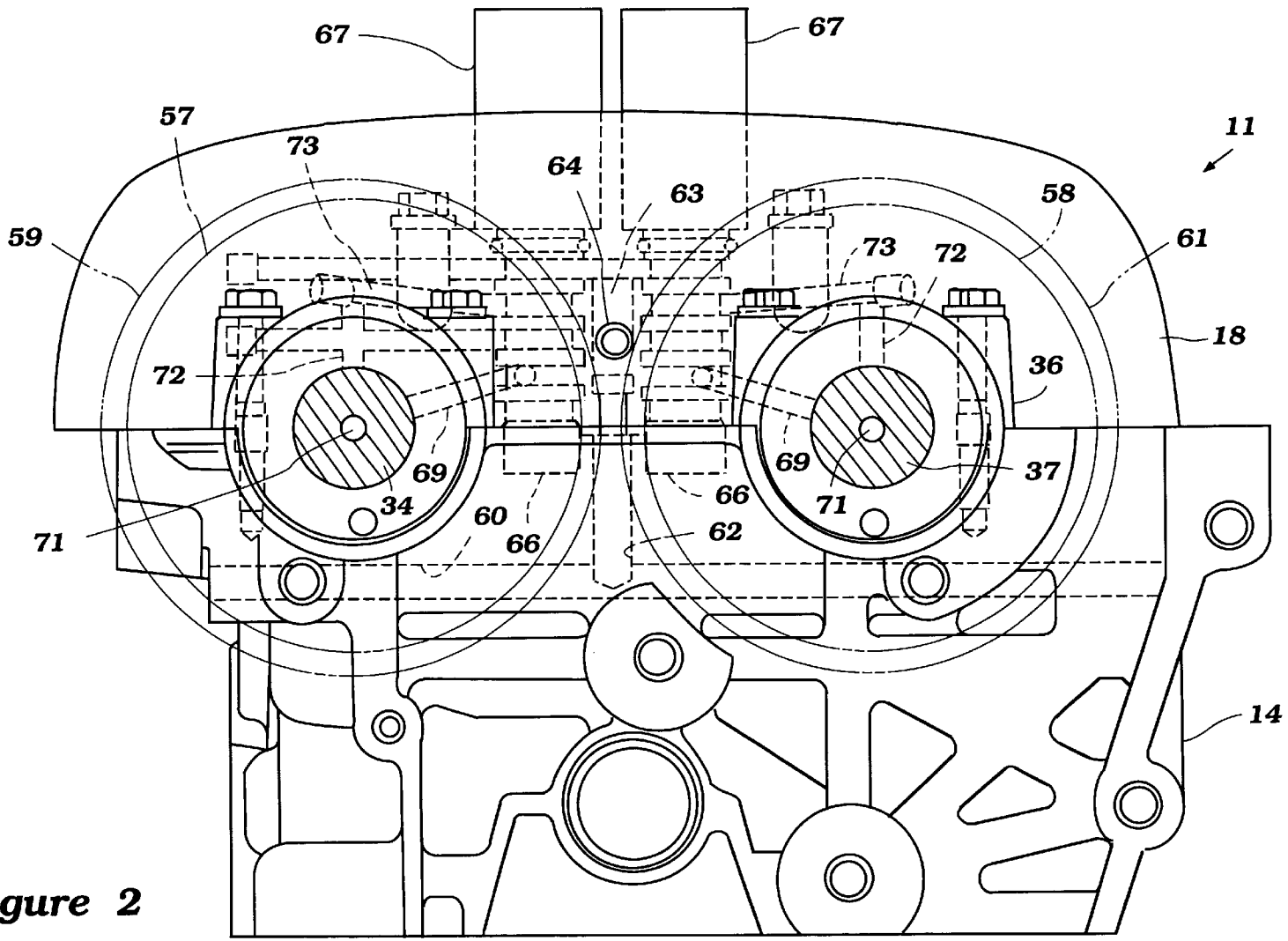
FIG. 2 is an enlarged, front elevational view of the camshaft drive arrangement for this embodiment.

The construction of the engine 11 has thus far described is generally that of the known type of engines with the exception of the front main bearing cap 36 and its orientation to the other components of the engine which will now be described in more detail by primary reference to FIGS. 2 through 4.

Figure 4:
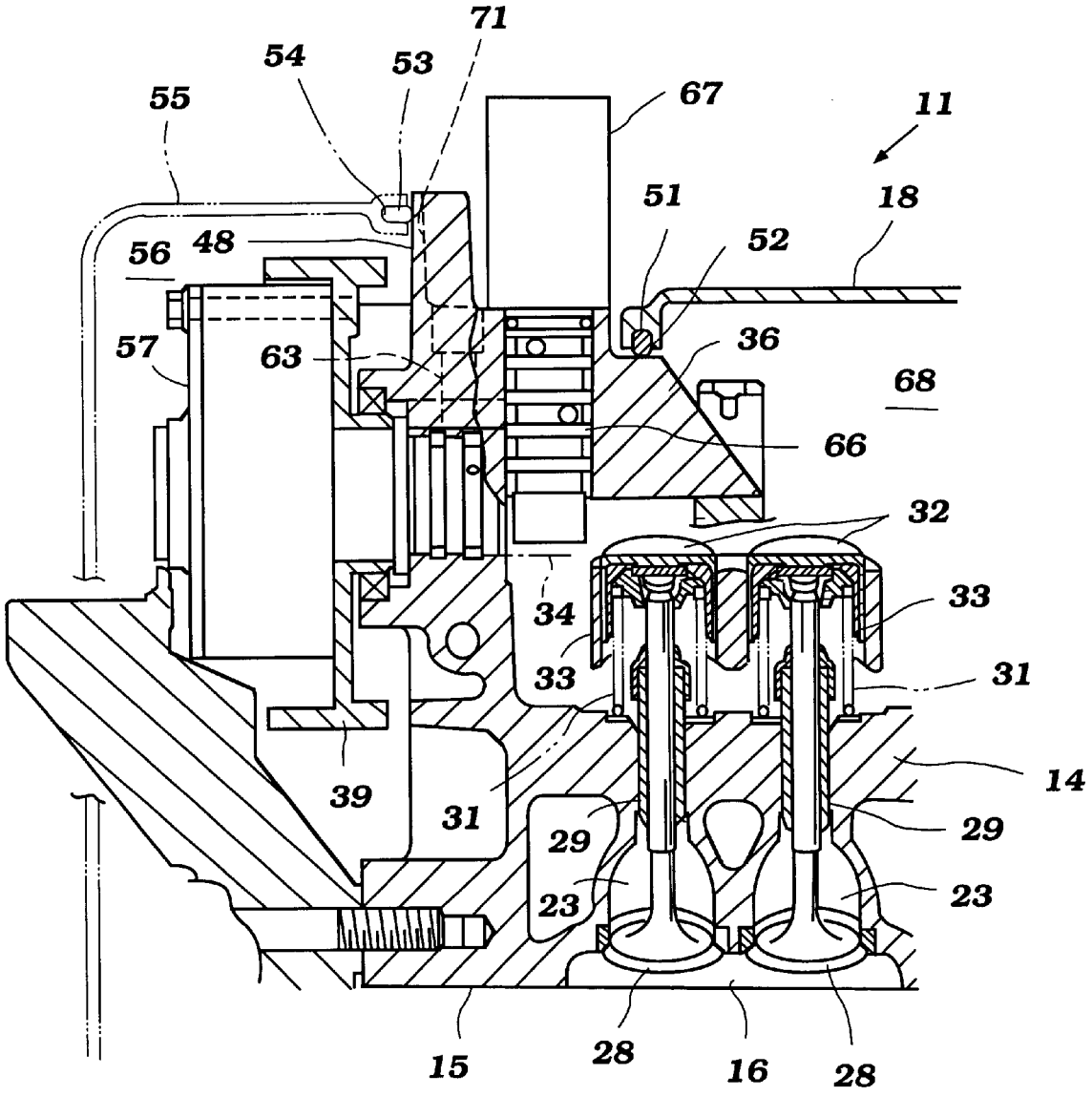
FIG. 4 is a cross sectional view taken along a plane perpendicular to the plane of FIG. 1 and shows the intake valves and relationship of the variable valve timing mechanism and the control valves.

As may be clearly seen in FIG. 4, the front main bearing cap 36 extends forwardly beyond the cam cover 18 and has an upstanding forward wall 48, which has a V-type projection 49, formed at its center. This portion of the front main bearing cap 36 extends outwardly beyond the front of the cam cover 18 and is sealed by a sealing gasket 51 trapped in a groove 52 in the forward end of the cam cover 18.

This forward wall 48 and the V-shaped portion 49 thereof is sealingly engaged by a further seal 53 that is carried in a groove 54 of a timing case cover 55. This timing case cover 55 encloses a camshaft drive or timing chamber 56 in which pair of variable valve timing mechanisms 57 and 58 are contained. These variable valve timing mechanisms 57 and 58 may be of any known type and are hydraulically operated, in a manner to be described shortly. These VVT mechanisms 57 and 58 transmit a drive from driving pulleys 59 and 61 which are associated therewith and which are driven from the engine crankshaft (not shown) through a timing belt.

Although a belt drive is illustrated and described, it should also be apparent that the invention can be utilized in conjunction with other types of camshaft drives including other types of flexible transmitted such as timing chains and/or gear drives or combinations thereof.

In accordance with the feature of this embodiment of the invention, the cylinder head 14 is provided with a centrally located, vertically extending main VVT oil gallery 62 that communicates with the lubricating system of the engine and specifically a main gallery 60 thereof. The main VVT oil gallery 62 terminates below the main bearing cap 36.

The main bearing cap 36 is provided with a vertically extending passage that communicates with this cylinder head passage 62 and in which a removable oil filter 63 is positioned. A single supply passage 64 is formed in the forward main bearing cap 36 and, in turn, is intersected by a single supply passage 65 that extends to a pair of spool valves 66 each of which is associated with a respective one of the variable valve timing mechanisms 57 and 58. These spool valves 66 are operated by solenoid motors 67 which extend upwardly from the area between the cam cover 18 and the timing case cover 55.

In other words, this valve mechanism including the valve spools 66 and their solenoids actuators 67 are disposed rearwardly of the timing case 56 and forwardly of the cam chamber 68 that is defined by the cam cover 18, main bearing cap 38 and cylinder head member 14. Thus, the variable valve timing mechanism can be easily serviced without removing either the cam cover 18 or the timing cover 55 in this embodiment. Furthermore, since there is only a single supply passage 62, filter 63 and passages 64 and 65, the entire mechanism can be serviced without disturbing any of the sealing gaskets 52 and 53.

Oil from the spool valves 66 is delivered to the VVT mechanisms through supply passages 69 formed in the main bearing cap 36 to grooves in the camshafts 34 and 37 and axially drilled passages 71 formed in the ends of the cam shafts 34 and 37. Return passages 72 and 73 cooperate with the spool valves 66 for pressure relief from the VVT mechanisms 57 and 58.

Thus, there will be adequate supply of pressure for the variable valve timing mechanisms 57 and 58 for their actuation and the cylinder head assembly and its drillings as well as those of the main bearing cap 36 are quite simplified. A removable cover may be positioned over the oil filter 63 as shown in broken lines at 74 so as to remove and service the filter element 63.

Figure 3:
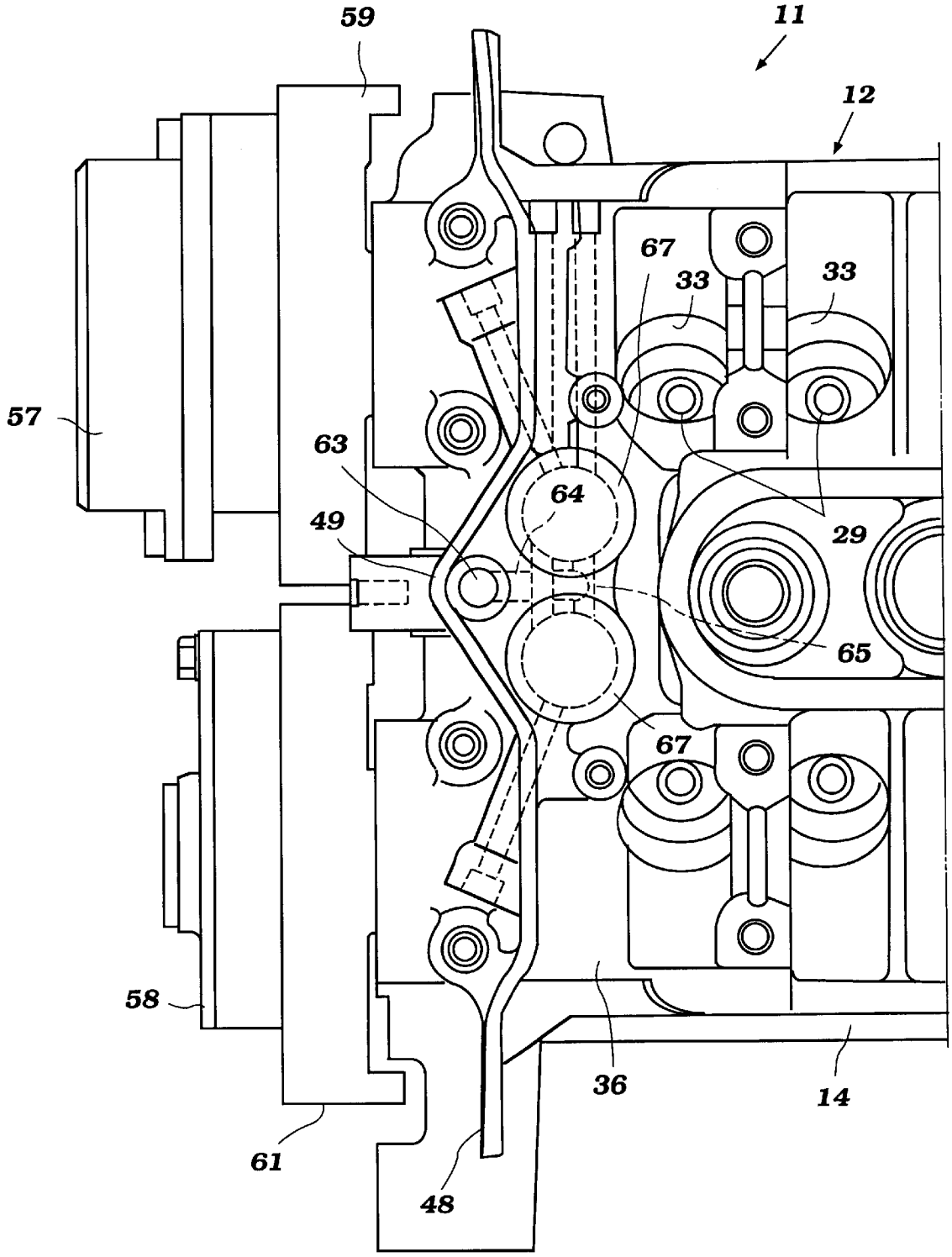
FIG. 3 is a top plan view, with the cam cover and valves and camshafts removed, showing the location and operation of the control valves for the variable valve timing mechanism.
Figure 5:
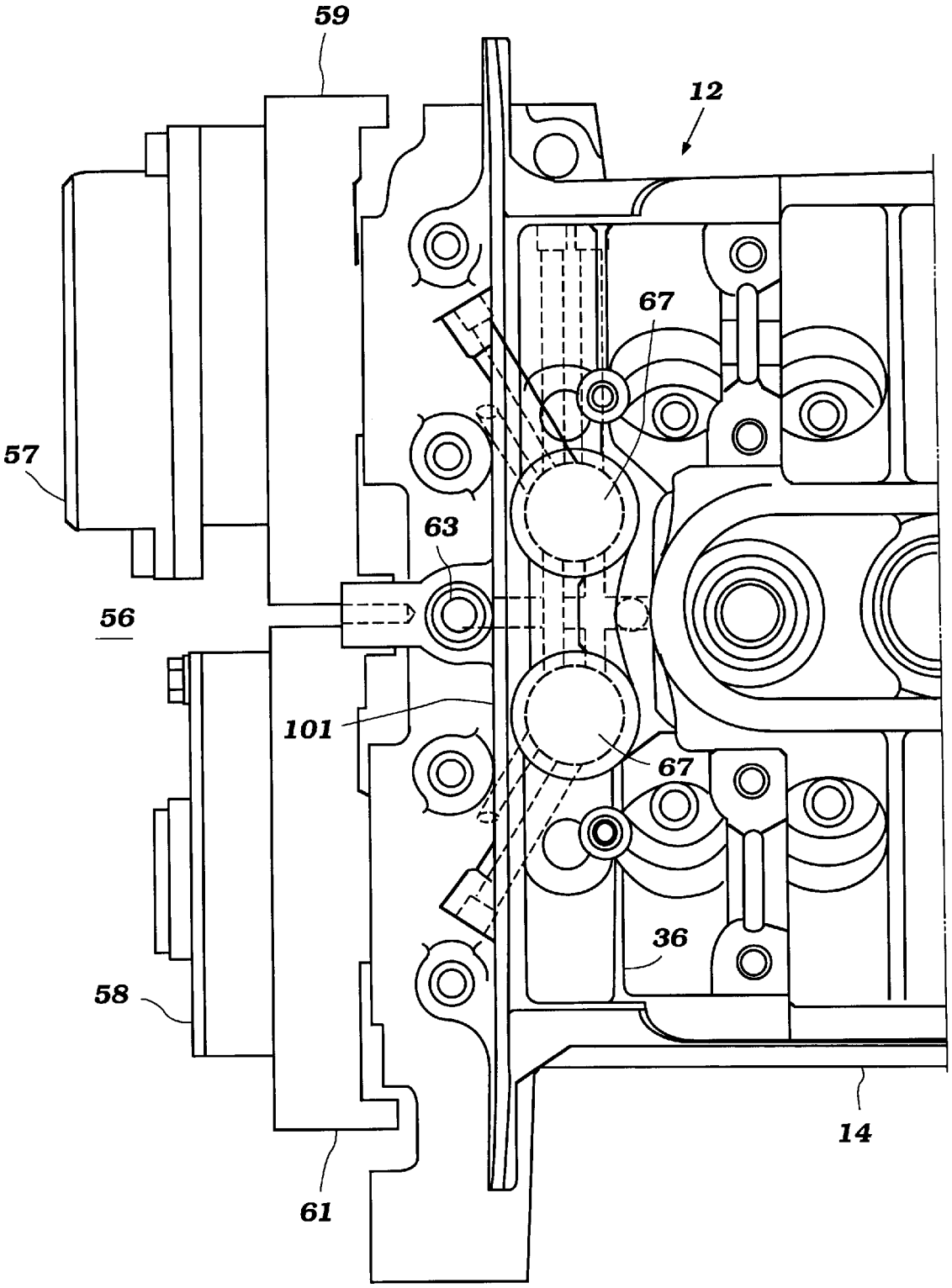
FIG. 5 is an enlarged top plane view, in part similar to FIG. 3, and shows another embodiment of the invention.

FIG. 5 is a view similar to FIG. 3 and shows another embodiment of the invention. This embodiment differs from the embodiment of FIGS. 1–4 only in that the front wall surface of the main bearing cap 36 is formed as a planer section, indicated at 101, and thus, extends to the rear of the oil filter 63. Therefore, the oil filter 63 is positioned so as to be contained within the timing case cover 55 and thus in the timing chamber 56 so that it can be accessed through removal of the cover 55. In this embodiment, therefore, the cam cover 18 extends forwardly over and encloses the rear portion of the front main bearing cap 36. The timing cover 18 in this embodiment is formed with openings through which the solenoid motors 67 extend so that they can be serviced by removal of the cam cover 18.

Figure 6:
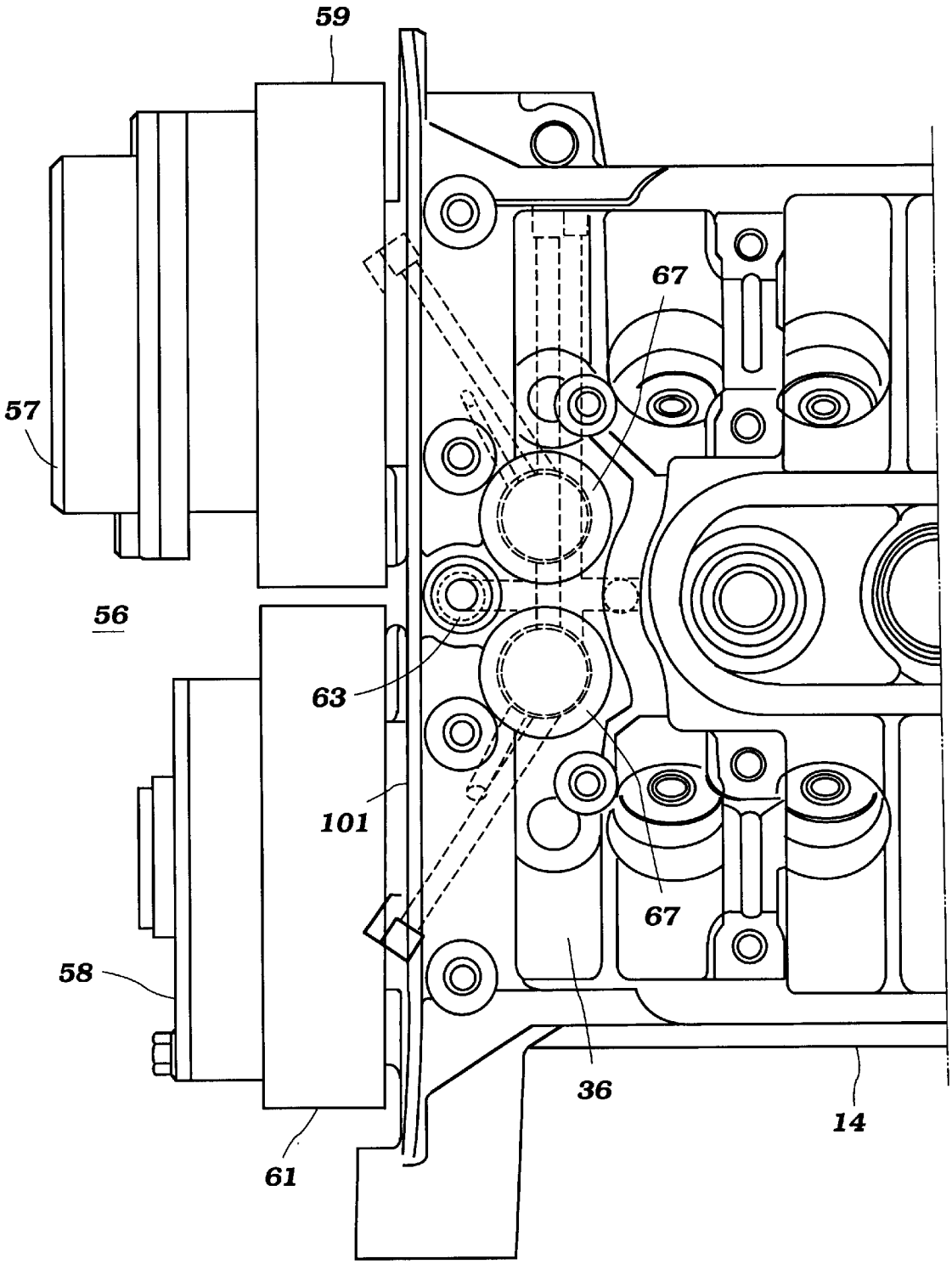
FIG. 6 is an enlarged top plan view, in part similar to FIGS. 2 and 5, and shows a third embodiment of the invention.

FIG. 6 shows a further embodiment that uses the planer front wall 101 for the main bearing cap 36 as in the previously described embodiment of FIG. 5. In this case, however, the oil filter 63 is located within the cam chamber 18 and hence all components of the variable valve timing mechanism may be serviced by removal of the cam cover 18. However, the solenoid operator 67 in this embodiment also extends through the cam cover 18 so that they can be removed and the valves 66 associated therewith also removed in this manner.

Thus, from the foregoing description, it should be readily apparent that the preferred embodiments of the invention all provide a very compact hydraulic system for operating the valve valve timing mechanism of an engine having twin overhead cams and in which the flow paths to each of the variable valve timing mechanisms and their control valves is very short and through a single passage so as to provide maximum pressure availability and minimize machining and likelihood of leakage. Of course, the foregoing description is that of a preferred embodiment of the invention and various changes and modifications may be made without departing from the spirit and scope of the invention, as defined by the appended claims.

What is claimed is:

1. An internal combustion engine comprised of a cylinder head assembly having a pair of camshafts rotatable about parallel axes for operating a plurality of valves in said cylinder head assembly, a camshaft drive mechanism provided at one end of said cylinder head assembly for driving said camshafts in timed relation to an engine output shaft, said camshaft drive for each of said camshafts including a variable valve timing mechanism including a hydraulically actuated element for varying valve timing, and a pair of control valves mounted in said cylinder head assembly in the area between said camshafts and disposed immediately adjacent to said variable valve timing mechanisms for controlling their individual operations.

2. An internal combustion engine as set forth in claim 1, wherein the control valves reciprocate about axes that are parallel to each other and disposed perpendicular to and between the axes of the cam shafts.

3. An internal combustion engine as set forth in claim 1, wherein a single supply passage formed in the cylinder head supplies control fluid to each of the control valves.

4. An internal combustion engine as set forth in claim 3, wherein the control valves reciprocate about axes that are parallel to each other and disposed perpendicular to and between the axes of the cam shafts.

5. An internal combustion engine as set forth in claim 4, wherein the single supply passage extends perpendicular to the control valves and lies between them.

6. An internal combustion engine as set forth in claim 5, wherein a single supply passage supplies control fluid to each of the control valves through a common cross drilled passage.

7. An internal combustion engine as set forth in claim 1, wherein the cam shafts are journalled adjacent the cam shaft drive by a common bearing cap.

8. An internal combustion engine as set forth in claim 7, wherein the common bearing cap also supports the control valves.

9. An internal combustion engine as set forth in claim 8, wherein the common bearing cap further supports individual solenoid actuators for operating selective ones of the control valves.

10. An internal combustion engine as set forth in claim 9, wherein the control valves reciprocate about axes that are parallel to each other and disposed perpendicular to and between the axes of the cam shafts.

11. An internal combustion engine as set forth in claim 10, wherein a single supply passage formed in the cylinder head supplies control fluid to each of the control valves through a single supply passage formed in the main bearing cap.

12. An internal combustion engine as set forth in claim 11, wherein the single main bearing cap supply passage extends perpendicular to the control valves and lies between them.

13. An internal combustion engine as set forth in claim 12, wherein the single main bearing cap supply passage supplies control fluid to each of the control valves through a common cross drilled passage in the main bearing cap.

14. An internal combustion engine as set forth in claim 9, wherein a timing case cover encloses the cam shaft drive and is sealingly engaged with the main bearing cap.

15. An internal combustion engine as set forth in claim 14, wherein the sealing engagement between the timing case cover and the main bearing cap extends generally perpendicular to the cam shaft axes.

16. An internal combustion engine as set forth in claim 9, wherein a cam cover encloses the cam shafts to form a camshaft chamber and is sealingly engaged with the main bearing cap.

17. An internal combustion engine as set forth in claim 16, wherein a timing case cover encloses the cam shaft drive and is sealingly engaged with the main bearing cap to form a timing case area.

18. An internal combustion engine as set forth in claim 17, wherein the control valves and their actuating solenoids are disposed externally of both of the timing case area and the cam shaft chamber.

19. An internal combustion engine as set forth in claim 17, wherein a single supply passage formed in the cylinder head supplies control fluid to each of the control valves through a single supply passage formed in the main bearing cap.

20. An internal combustion engine as set forth in claim 19, wherein the control valves and their actuating solenoids are disposed externally of both of the timing case area and the cam shaft chamber.

* * * * *